US008716955B2

(12) United States Patent
Chuang et al.

(10) Patent No.: US 8,716,955 B2
(45) Date of Patent: May 6, 2014

(54) CONSTANT CURRENT LED DRIVER

(75) Inventors: San Chuang, New Taipei (TW); Joe Chen, New Taipei (TW); Rocky Shi, New Taipei (TW); Justin Chang, New Taipei (TW)

(73) Assignee: LINKCOM Manufacturing Co., Ltd., New Taipei (TW)

( * ) Notice: Subject to any disclaimer, the term of this patent is extended or adjusted under 35 U.S.C. 154(b) by 21 days.

(21) Appl. No.: 13/558,418

(22) Filed: Jul. 26, 2012

(65) Prior Publication Data

US 2014/0028212 A1 Jan. 30, 2014

(51) Int. Cl.
*H05B 37/02* (2006.01)

(52) U.S. Cl.
USPC ..... 315/307; 315/276; 315/312

(58) Field of Classification Search
USPC ..... 315/209 R, 224–226, 274, 276, 287, 315/291, 297, 307, 308, 312
See application file for complete search history.

(56) References Cited

U.S. PATENT DOCUMENTS

| | | | | |
|---|---|---|---|---|
| 7,781,982 | B2 * | 8/2010 | Tatsumi | 315/291 |
| 8,587,220 | B2 * | 11/2013 | Kimura | 315/307 |
| 2004/0037098 | A1 * | 2/2004 | Konno | 363/49 |
| 2012/0243269 | A1 * | 9/2012 | Ren et al. | 363/21.12 |
| 2012/0262080 | A1 * | 10/2012 | Watanabe et al. | 315/210 |
| 2012/0293087 | A1 * | 11/2012 | Matsuda et al. | 315/219 |

* cited by examiner

*Primary Examiner* — Tung X Le

(57) ABSTRACT

The LED driver includes a rectifier, a switching circuit and a feedback circuit. The rectifier connects an AC power source and outputting DC power. The switching circuit connects the DC power of the rectifier to switch the DC power with pulse width modulation (PWM) and has an output end for connecting a load and a feedback control end. The feedback circuit is connected between the output end and the feedback control end of the switching circuit for controlling a duty cycle of the switching circuit depending on an output current of the output end to keep the output current constant.

5 Claims, 2 Drawing Sheets

CONSTANT CURRENT LED DRIVER

BACKGROUND OF THE INVENTION

1. Technical Field

The invention relates to drivers, particularly to an electronic driver for providing a constant current source to multiple LED loads in parallel.

2. Related Art

Light emitting diodes feature long life and low power consumption and have become a primary of light source.

To illuminate LEDs, a driver is necessary. Usually, a plurality of LEDs are combined into a module as a load of the driver. In practice, a single driver is frequently used to drive multiple loads (LED modules) in parallel. Thus, a design target of the driver is to make all loads (LED modules) shine correspondingly. This target can be achieved by a constant voltage or current source.

The cheapest solution of a constant voltage driver is to add a current-limiting resistor connecting with an LED load in series and to provide a constant voltage source. However, such a current-limiting resistor will reduce the passing current. And the nonlinear V-I curve of the LED load cannot make the current stable enough. Additionally, the current passing the LEDs must vary when external voltage or forward current of LED changes. Suppose a current of 20 mA passes an LED when a rated forward voltage is 3.6V. If the voltage is changed into 3V (still in the allowable range of 3V to 4V) due to variation of temperature or modification of manufacture process, the forward current will drop to 14 mA. In other words, when the forward voltage is changed 11%, the forward current will vary 30%. Such a severe variation can change brightness of LEDs, which cannot be accepted by many apparatuses.

Because conventional constant current drivers are complicated in circuit and require so many components, it is hard to improve the yield rate and to reduce manufacture costs and volume. Additionally, when multiple LED loads in parallel are driven by a single driver and one of the loads is unexpectedly removed, the total current provided by the driver will be directly distributed among the remaining loads. This may damage the LEDs.

SUMMARY OF THE INVENTION

An object of the invention is to provide a constant current LED driver, which is cheaper, more stable and compact than ever.

Another object of the invention is to provide a constant current LED driver, which can keep the currents in all LED loads constant when one of multiple LED loads in parallel is removed. Thus life of the LEDs will not be shortened.

To achieve the above objects, the LED driver of the invention includes a rectifier, a switching circuit and a feedback circuit. The rectifier connects an AC power source and outputting DC power. The switching circuit connects the DC power of the rectifier to switch the DC power with pulse width modulation (PWM) and has an output end for connecting a load and a feedback control end. The feedback circuit is connected between the output end and the feedback control end of the switching circuit for controlling a duty cycle of the switching circuit depending on an output current of the output end to keep the output current constant.

DETAILED DESCRIPTION OF THE INVENTION

Figure 1:
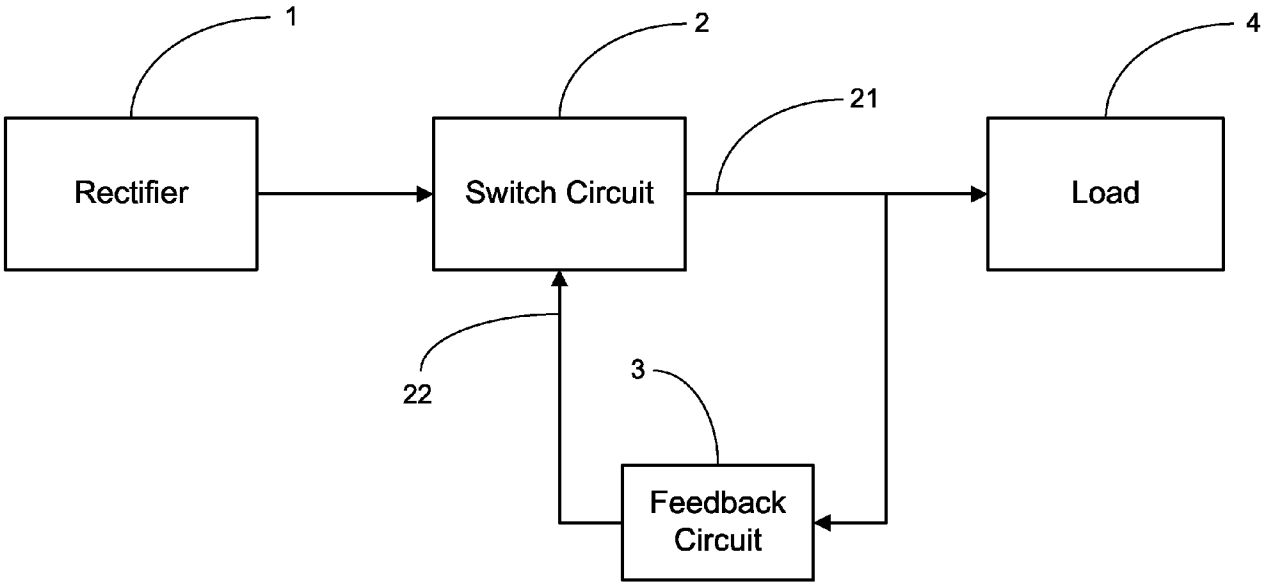
FIG. 1 is a block diagram of the invention.

Please refer to FIG. 1. The constant current LED driver is used to drive LEDs to light up stably. The driver includes a rectifier 1, a switching circuit 2 and a feedback circuit 3. The LED driver of the invention includes a rectifier 1, a switching circuit 2 and a feedback circuit 3. The rectifier 1 connects an AC power source and outputting DC power. The switching circuit 2 connects the DC power of the rectifier 1 to switch the DC power with pulse width modulation (PWM). The switching circuit 2 has an output end 21 for connecting an LED load 4 and a feedback control end 22. The feedback circuit 3 is connected between the output end 21 and the feedback control end 22 of the switching circuit 2 for controlling a duty cycle of the switching circuit 2 depending on an output current of the output end 21 to keep the output current constant.

Figure 2:
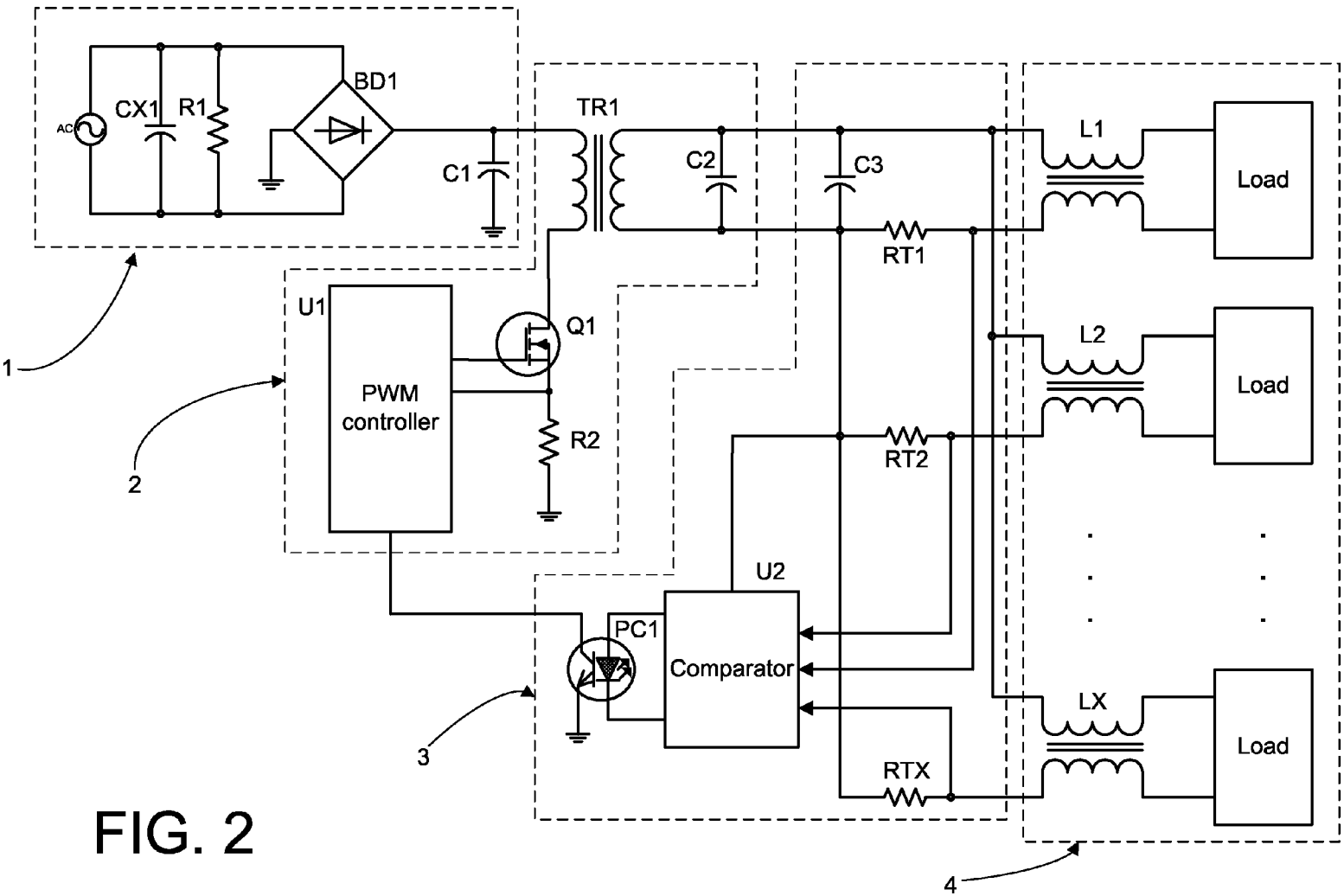
FIG. 2 is a circuit diagram of the invention.

Please refer to FIG. 2. The driver of the invention converts AC power to DC power for driving LEDs to light up and has the feedback circuit 3 to keep the output current constant. The rectifier 1 can be implemented by a bridge rectifier BD1, capacitors CX1, C1 and resistor R1. Of course, it can also be implemented by other types or components.

The rectifier 1 converts AC power to DC power. The DC power output by the rectifier 1 is sent to the switching circuit 2. The switching circuit 2 is a high frequency switching DC-to-DC Converter and composed of a high frequency transformer TR1, an electronic switch Q1 and a pulse width modulation (PWM) controller U1. The primary winding of the high frequency transformer TR1 is connected to the DC power output of the rectifier 1. Switching contacts of the electronic switch Q1 are connected between the primary winding of the high frequency transformer TR1 and the ground. A resistor R2 may be connected therebetween in series. A control pin of the electronic switch Q1 is connected to the PWM controller U1 so that the electronic switch Q1 can be controlled by the PWM controller U1 to change its switching frequency and duty cycle. The electronic switch Q1 may be, but not limited to, a metal-oxide-semiconductor field-effect transistor (MOSFET), bipolar junction transistor (BJT) or isolated gate bipolar transistor (IGBT). The feedback control end 22 of the PWM controller U1 can accept feedback signal input to change duty cycle of the electronic switch Q1.

The DC current from the output end 21 of the switch circuit 2 is connected to the load 4 and feedback circuit 3. The load 4 is one or more LED modules and may be one or more branches in parallel. The shown embodiment is of the type of multiple branches in parallel. Preferably, a choke L1, L2 . . . LX can be connected between each branch of load 4 and the output end 21 of the switch circuit 2 for stabilizing the driving currents.

A conversion resistor RT1, RT2 . . . RTX is connected in each loop formed by the switch circuit 2 and a branch of load 4. The conversion resistors RT1, RT2 . . . RTX are the same in resistance value. Two ends of each the conversion resistor RT1, RT2 . . . RTX are connected to an input end of a comparator U2 composed of operation amplifiers. Because the conversion resistors RT1, RT2 . . . RTX are separately connected with the loads 4 in series, the currents passing the conversion resistors RT1, RT2 . . . RTX are equal to the currents passing the loads 4. Thus, the conversion resistors RT1, RT2 . . . RTX can convert the passing currents to voltage signals. The comparator U2 can obtain the load currents to compare with a threshold. The output end of the comparator U2 connects an input end (the LED side) of a photocoupler PC1. An output end of the photocoupler PC1 is connected to the feedback control end 22 of the PWM controller U1 for outputting a feedback signal to the PWM controller U1. Because the conversion resistors RT1, RT2 . . . RTX are the same in resistance value, when a branch of LED load 4 is removed, voltages of the conversion resistors RT1, RT2 . . . RTX connecting with the other branches of loads 4 will be greater than a threshold (i.e. a fault occurs), and the comparator U2 will control the photocoupler PC1 to open and close. This will change the feedback signal to adjust the duty cycle of the PWM controller U1 and the turn-on time period of the electronic switch Q1. Finally, the output current can be adjusted to keep the currents passing each load constant. The current passing the load 4 which is removed is zero and the voltage of the conversion resistor RT1, RT2 . . . RTX connecting with the removed load is zero, too. This will not interfere with the normal operation of the comparator U2.

It will be appreciated by persons skilled in the art that the above embodiment has been described by way of example only and not in any limitative sense, and that various alterations and modifications are possible without departure from the scope of the invention as defined by the appended claims.

What is claimed is:

1. A light emitting diode (LED) driver comprising:

a rectifier, connecting an alternating current (AC) power source and outputting direct current (DC) power;

a switching circuit, connecting the DC power of the rectifier, switching the DC power with pulse width modulation (PWM), and having an output end for connecting a load and a feedback control end; and a feedback circuit, connected between the output end and the feedback control end of the switching circuit for controlling a duty cycle of the switching circuit depending on an output current of the output end to keep the output current constant;

wherein the feedback circuit comprises a conversion resistor, a comparator and a photocoupler, the conversion resistor connected in a loop formed by the switch circuit and the load, two ends of the conversion resistor are connected to an input end of a comparator, an output end of the photocoupler is connected to the feedback control end of the PWM controller for outputting a feedback signal to the PWM controller, when a voltage fault of the conversion resistor occurs, the comparator controls the photocoupler to open and close.

2. The LED driver of claim 1, wherein the switching circuit comprises a high frequency transformer, an electronic switch and a pulse width modulation (PWM) controller, a primary winding of the high frequency transformer is connected to the DC power of the rectifier, switching contacts of the electronic switch are connected between the primary winding of the high frequency transformer and a ground, and a control pin of the electronic switch is connected to the PWM controller so that the electronic switch is controlled by the PWM controller to change its switching frequency and duty cycle.

3. The LED driver of claim 2, wherein the electronic switch is a metal-oxide-semiconductor field-effect transistor (MOSFET), bipolar junction transistor (BJT) or isolated gate bipolar transistor (IGBT).

4. The LED driver of claim 1, wherein the comparator is composed of operation amplifiers.

5. The LED driver of claim 1, wherein the output end of switch circuit connects multiple loads in parallel, each branch of load is connected with a conversion resistor, the conversion resistors are the same in resistance value; when a branch of load is removed, voltages of the conversion resistors connecting with the other branches of loads leis greater than a threshold, the comparator controls the photocoupler to open and close so as to change the feedback signal to adjust duty cycle of the PWM controller and a turn-on time period of the electronic switch, and the output current is adjusted to keep currents passing each load constant.

* * * * *